United States Patent [19]

Von Stutterheim et al.

[11] 4,081,335

[45] Mar. 28, 1978

[54] PROCESS FOR THE CONTINUOUS ELECTROLYTIC PLATING OF METAL WIRE, STRIPS, CHAINS, AND GAUZE STRIPS WITH METALS

[76] Inventors: Friedrich Von Stutterheim, Adenauerallee 7, 637 Oberursel; Jörg Wurm, Kantstrasse 1/9, 8755 Alzenau-Kalberau, both of Germany

[21] Appl. No.: 624,000

[22] Filed: Oct. 20, 1975

[30] Foreign Application Priority Data

Oct. 23, 1974 Germany ..... 2450291

[51] Int. Cl.[2] ..... C25D 3/66; C25D 7/06

[52] U.S. Cl. ..... 204/28; 204/39; 204/206; 204/245

[58] Field of Search ..... 204/28, 39, 206, 243 R, 204/245, 208, 207, 209, 210, 211; 106/39.5, 43, 44

[56] References Cited

U.S. PATENT DOCUMENTS

| | | | |
|---|---|---|---|
| 3,007,854 | 11/1961 | Smith et al. | 204/28 |
| 3,136,709 | 6/1964 | Smith et al. | 204/28 |
| 3,267,008 | 8/1966 | Smith et al. | 204/28 |
| 3,467,585 | 9/1969 | Caubet | 204/39 |
| 3,649,510 | 3/1972 | Smith et al. | 204/238 |

OTHER PUBLICATIONS

A. Kenneth Graham, "Electroplating Engineering Handbook", pp. 518–519, (1962).

Chemical Engineering, pp. 130, 132 & 134, Oct. 3, 1960.

G. R. Smith et al., Plating, pp. 805–808, July 1969.

*Primary Examiner*—G. L. Kaplan

*Attorney, Agent, or Firm*—Richards, Harris & Medlock

[57] ABSTRACT

A process of electro-plating elongate articles of passive metal with a thin, homogeneous coating of a noble metal. The article is passed through an electrolyte bath comprising a salt melt of alkali metals or alkaline earth metals containing a cyano radical. The articles are guided through the bath by guides of a material selected from oxides of aluminum, silicon, yttrium, or zirconium; nitrides of silicon, borium, or titanium; or carbides of silicon or titanium. The entire process is carried out in an inert atmosphere.

3 Claims, No Drawings

PROCESS FOR THE CONTINUOUS ELECTROLYTIC PLATING OF METAL WIRE, STRIPS, CHAINS, AND GAUZE STRIPS WITH METALS

The invention relates to a process for electrolytic plating of metal wire, strips, chains, and gauze strips by continuous passage through a molten salt bath.

For electroplating of metal wire, strips, and others in aqueous electrolytes technically proven processes are available. All these processes have in common that the continuous metal material is cathodically contacted outside the electrolyte and passed through the electrolyte using guide rollers. Parts which are in contact with the electroplated material should be electrical insulators in order not to be coated. With plastics and ceramics many suitable materials are available. All electroplating processes in aqueous electrolytes are limited in their application in that:

(a) At the cathode not only the desired metal is deposited but also non-metallic bath additives are incorporated in the metal layer which are added to promote fine-grain structure and luster of the deposit. These additives, and hydrogen which is discharged simultaneously with the metal and also incorporated, change the physical, chemical, and mechanical properties of a galvanoformed metal in comparison to the compact metal which is undesirable for many applications. Also the mechanical properties of those substrate metals are changed which tend to hydrogen-embrittlement.

(b) Substrate metals with a high affinity to oxygen are passivated in aqueous electrolytes. On the passivating oxide or hydrated oxide films a metal coating grows only with poor adherence and with pore-formation because of partial passivation. No electroplating in aqueous electrolytes is possible for substrates with high oxygen affinity.

(c) Because of the low deposition temperatures in aqueous electrolytes metal plates grow with internal stress and tend to form cracks because of their defective structure. They possess a reduced density and ductility.

(d) The anion diffusion in the electrolyte limits the maximum current density. Large current densities can only be obtained by large anion concentrations, or optionally by addition of the acid of the metal salt used for deposition. This increases the hydrogen evolution at the cathode and also the problems mentioned under a).

Due to these reasons many metal coatings cannot yet be produced by electroplating with known processes. For example, wire of strongly passivating metals like tungsten, molybdenum, tantalum, and iron-nickel cannot be or can only unsatisfactorily be platinised, having too thin a coating or being unsuitable for vacuum or high temperature applications. In these cases, it is necessary to take a cylindrical block of substrate metal surrounded by a tube of coating metal which are then drawn to a platinum plated wire.

It is practically impossible to obtain a homogeneous coating of only a few microns thickness by this process.

Therefore, unusually high thicknesses have to be employed in order to ensure that a sufficiently thick coating will be present also at the thinnest areas. This process leads to a disproportionately high consumption of precious coating metals.

The present invention provides a procedure of electroplating with strongly adhering coatings without using interlayers also on such substrate metals which cannot be or can only insufficiently be coated in aqueous electrolytes because of their passivating tendency. Furthermore, it is essential that this process can be run continuously in order to be able to uniformly coat larger lengths at high working speeds.

Surprisingly, these problems are solved and more advantages are attained by using molten metal salts or inorganic and/or organic acids as electrolyte for the process described in the beginning. The molten salts used are the cyanides and/or thiocyanates and/or cyanamides of the alkali or alkaline earth metals which may optionally contain cyanates and/or carbonates of alkali or alkaline earth metals, and to which a salt of the deposition metal is added, or in which a salt of the deposition metal is formed chemically or electrochemically in situ. The process of the invention involves a series of remarkable advantages over the use of aqueous electrolytes, including:

(a) The metals are deposited without simultaneous incorporation of organic or inorganic bath additives and thus well-adhering, crack-free coatings of any thickness can be produced.

(b) As the used molten salt electrolytes are free of water the formation of passivations of the base metal is reduced and thus non-porous coatings even of low thickness can be produced. Using this invention also substrate metals can be coated which evade deposition in aqueous electrolytes by passivation, i.e. by formation of oxides and hydrated oxide films.

(c) As molten salt electrolytes are stable over a large temperature range, it is always possible to produce layers which grow free of stress because of sufficient surface-diffusion; at high enough working temperatures it is even possible to diffuse the coating metal partially or completely into the substrate metal.

(d) By a suitable choice of the salt composition it is possible to work with an anion concentration of 100% so that the applied current density is not limited by anion diffusion.

(e) Using the invention it is possible to deposit metals for which aqueous electrolytes do not yet exist or cannot exist due to general reasons.

With the process of the invention a series of unsolved or not yet satisfactorily solved problems can be brought to an advantageous, cost-saving solution.

Wire of high temperature resistant base metals can be plated with platinum metals and their alloys according to this invention. They can be worked to nets for ammonia-oxidation-catalysis. Hitherto those nets had to be fabricated of compact noble metal wire which was transformed to platinum black during this process. The transformation and breaking of the nets resulted in a high platinum loss. This limited service time concerned not only combustion catalysts of platinum/rhodium but also recuperation catalysts of gold/palladium. Heavy-duty electron tubes are provided with grids of molybdenum and tungsten wire which are subjected to deposition of thorium oxide. Thereby the grids themselves become sources of a disturbing emission of secondary electrons. This secondary emission can be reduced by coating with a metal of high electron work function, i.e. with platinum metals and/or gold. The invention is suitable for coating wire used in high vacuum as it allows the fabrication of gas-free, well-adhering layers. This cannot be achieved by aqueous electroplating as listed above.

In some important electrochemical processes unsoluble metal anodes are used which are activated by platinum or platinum metals. Platinised tantalum wire can be used for persulfateoxidation according to this invention, replacing drawn platinum/silver core composite wire. Thus, platinum can be saved and the service life can be increased because of the chemical resistance of the tantalum core.

Platinised titanium wire is increasingly used for cathodic corrosion protection of the interior of pipes which carry salt, fresh and sewage water or chemical solutions. So far, they have been coated by a pyrochemical process. It was technically not possible to coat also niobium, tantalum, and zirconium wire which can also be used satisfactorily for this purpose. With the process of the invention titanium and also niobium and tantalum wire can be coated with especially well-adhering nobel metal coatings. This opens the use of niobium and tantalum for cathodic corrosion protection whereby higher impressed voltages and current densities are available for corrosion protection even in aggressive media.

The fabrication of superconducting cables and flexibile wire of niobium and niobium alloys requires that the superconducting material is provided with a sheeting or core of material of high conductivity under ambient conditions. By coating a copper wire with niobium in one of the salt metals of the invention new techniques are available which can replace the currently used cumbersome drawing of composite wire.

The choice of the composition of the salt melt can also be made under the aspect of a melting point as low as possible. Therefore, alkali and alkaline earth metal salt melts are used, preferably melts with a high content of alkali metal cyanide (i.e. mixtures of potassium and sodium cyanide). Doing this one is free to work either in an oxygen-free system in order to prevent passivation of base metals or to add oxygen-containing salts, i.e. alkali metal carbonates and/or cyanates to the melt or to produce them in situ in order to attain passivation of base metals. The salts are molten in a resistant crucible of ceramic material, graphite or metal, working in an inert gas atmosphere of nitrogen or noble gas according to the composition of the melt. If the system should be completely free of oxygen, it is self-evident to prepare the melt and to practise the process under an inert gas or under vacuum.

The deposition metal can be dissolved in the melt in form of a suitable salt. Those salts are especially suitable the anions of which correspond to the anions of the melt. For example, palladium(II)-cyanide, platinum(II)-cyanide, or silver(I)-cyanide can be dissolved in alkali metal cyanide melts to obtain suitable baths for the process.

On the other hand, it is also possible to produce chemically or electrochemically in situ a salt suitable for deposition. Processes of this kind are described in U.S. Pat. Nos. 2,093,406; 2,929,766; 3,309,292, and 3,547,789, or in our co-pending U.S. application, Ser. No. 565,106 (British application 14609/75) according to which metals, metal alloys, or composite metals are dissolved in metal cyanide and/or metal cyanamide and/or metal thiocyanate melts by adding reagents to the melt which form CN- or CNO-radicals or liberate such radicals from the melt under the reaction conditions. Details are given in said application.

It is a special advantage of the salt melts used in the practice of this invention that suitable materials can be selected with which not only a mechanical mounting but also an electrically insulated guidance of the semi-finished material can be obtained although the temperature of the molten salts measures several 100° C. It turned out that rollers, cylinders, and fixed thread guides of oxide, nitride, oxynitride, and carbide ceramics are chemically and thermally resistant and also possess a sufficient electrical resistance that neither these parts nor the metallic mountings holding them are coated during the electroplating process. Especially materials consisting of oxides of aluminum, beryllium, silicon, yttrium, and zirconium, of nitrides of silicon, boron, and titanium, or of carbides of silicon and titanium are suitable. Those metals proved to be resistant materials for the mountings which by their high affinity to oxygen can be passivated by a getter process in the melt or separately outside the melt. This group of metals comprises among others aluminum, beryllium, molybdenum, niobium, tantalum, titanium, tungsten, zirconium, and alloys with a high content of these metals. The mountings may be fabricated of compact corrosion-resistant metals or of non-resistant metals if the latter are protected against corrosion attack of the melt by a coating with a dense layer of the named metals or with resistant nobel metals.

The following examples to which the invention is not limited shall illustrate the invention:

EXAMPLE 1

51 percent by weight of potassium cyanide and 49 percent by weight of sodium cyanide are melted together and 2 percent by weight of palladium(II)-cyanide are then dissolved in it at 570° C. Keeping the temperature of the melt at this value, a 0.2 mm thick iron nickel wire (Fe49Ni) is coated with 7 microns palladium at a current density of 125 mA/cm$^2$. In doing so the wire is contacted electrically with a current supply roller outside the melt and returned with alumina thread guide rollers to the melt. For mounting the rollers a support of compact titanium is used. Compact palladium sheets were applied as anodes. The throwing power of the electrolyte allowed a homogeneous coating of the wire. A wire of 250 meters could be coated continuously without any difficulty.

EXAMPLE 2

68 percent by weight of potassium cyanide and 32 percent by weight of potassium thiocyanate are melted together and then 3.5 percent by weight of platinum are electrochemically dissolved in the melt. A molybdenum foil with a cross section of 3 by 0.03 millimeters and a length of 75 meters is coated with 3 microns platinum in this electrolyte at 450° C at a current density of 450 mA/cm$^2$. The molybdenum foil is flanked by platinum anodes on both narrow sides.

EXAMPLE 3

4 percent by weight of silver cyanide are dissolved in a melt of potassium cyanide and sodium cyanide. At 540° C an aluminum wire with a diameter of 2 millimeters is coated with 30 microns silver at a current density of 270 mA/cm$^2$ while the entire system is operated under an inert gas atmosphere of argon. The length of the continuously coated wire was 180 meters.

EXAMPLE 4

A melt of potassium and sodium thiocyanate was prepared in which 8 percent by weight of tin ferrocyanide are dissolved. A copper strip with a cross section of 5 by 0.5 millimeters was coated with a 10 microns thick tin layer at a current density of 520 mA/cm$^2$. The strip is contacted outside the bath by a current supply roller and returned to the melt by three rollers of reaction-sintered silicon nitride in such a manner that the strip had a double length of dwell in the melt compared to the one being returned. The rollers are held by a mounting of tantalum-coated steel.

EXAMPLE 5

By using the melt of example 1 which, however, contained 2 percent by weight of platinum and by using the arrangement of example 1, a 0.7 millimeter molybdenum wire was coated with 3 microns platinum at a temperature of 580° C and a current density of 180 mA/cm$^2$. Two platinum sheet anodes were arranged at the side. The continuously plated wire measured 220 meters.

What we claim is:

1. A process for electro-plating an elongate, thin article formed from a base metal with a uniform, pore-free coating of a noble metal having a thickness in the micron range comprising:

passing the article through an electrolyte bath comprising a melt of at least one salt selected from the group consisting of alkali metal cyanides, alkali metal thiocyanates, alkali metal cyanamides, alkaline earth metal cyanides, alkaline earth metal thiocyanates, alkaline earth metal cyanamides, said bath further including a salt of the noble metal to be plated, guiding the article through the bath by means of ceramic guides comprising at least one material selected from the group consisting of aluminum oxide, silicon oxide, yttrium oxide, zirconium oxide, silicon nitride, borium nitride, titanium nitride, silicon carbide, and titanium carbide, the step of passing the article through the bath being carried out in the absence of gaseous oxygen.

2. The process according to claim 1 wherein the electrolyte bath further comprises at least one salt selected from the group consisting of alkali metal cyanates, alkali metal carbonates, alkaline earth metal cyanates, and alkaline earth metal carbonates.

3. The process according to claim 1 wherein the ceramic guides for the elongate article are supported by members at least the portions of which that are exposed to the bath are selected from the group consisting of aluminum, beryllium, titanium, zirconium, tungsten, niobium, molybdenum, tantalum, and alloys thereof.

* * * * *